US005952603A

United States Patent [19]

Parrott

[11] Patent Number: 5,952,603

[45] Date of Patent: Sep. 14, 1999

[54] INSERT AND TWIST METHOD AND APPARATUS FOR SECURING A SHAPED CHARGE TO A LOADING TUBE OF A PERFORATING GUN

[75] Inventor: Robert A. Parrott, Houston, Tex.

[73] Assignee: Schlumberger Technology Corporation, Sugar Land, Tex.

[21] Appl. No.: 09/167,846

[22] Filed: Oct. 7, 1998

Related U.S. Application Data

[62] Division of application No. 08/004,024, Jan. 15, 1993, Pat. No. 5,862,758.

[51] Int. Cl.[6] ..... F42B 3/00

[52] U.S. Cl. ..... 102/312; 102/313

[58] Field of Search ..... 102/312, 313

[56] References Cited

U.S. PATENT DOCUMENTS

| | | | |
|---|---|---|---|
| 2,796,022 | 6/1957 | Delacour . | |
| 3,040,615 | 6/1962 | Johansson et al. . | |
| 4,681,037 | 7/1987 | Regalbuto . | |
| 4,716,833 | 1/1988 | Regalbuto . | |
| 4,739,707 | 4/1988 | Regalbuto et al. . | |
| 4,800,815 | 1/1989 | Appledorn et al. . | |
| 4,817,531 | 4/1989 | Walker et al. . | |
| 4,832,134 | 5/1989 | Gill . | |
| 4,915,029 | 4/1990 | Appledorn et al. . | |
| 5,155,293 | 10/1992 | Barton | 102/313 |

*Primary Examiner*—Peter A. Nelson
*Attorney, Agent, or Firm*—John J. Ryberg; John Bouchard

[57] ABSTRACT

A loading tube of a perforating gun includes a plurality of mating holes, where each mating hole has a specific and predetermined contour, and a case of a shaped charge, adapted to fit within the mating hole, includes a pair of retaining lugs and a pair of shoulder lugs, which lugs are adapted to uniquely cooperate with the contour of the mating hole of the loading tube for securing the shaped charge to the loading tube. The predetermined contour of each mating hole includes a pair of slots disposed opposite one another in the mating hole, and a pair of grooves disposed opposite one another in the mating hole but offset from the pair of slots. Each pair of grooves includes a large radius groove and a small radius groove. The pair of retaining lugs of the shaped charge case are adapted to be received, respectively, in the pair of slots of the contour of the mating hole; whereas the pair of shoulder lugs are adapted to be initially received in the pair of large radius grooves of the contour of the mating hole. When the shaped charge is twisted clockwise in a circumferential direction, the retaining lugs move out of their respective slots and under a surface of the loading tube; in addition, the shoulder lugs moves out of their respective large radius grooves and into their respective small radius grooves. The shaped charge case is now firmly held within the mating hole of the loading tube. No clips, bending tabs, retaining rings, or charge retention jackets are being used to hold the shaped charge to the loading tube; therefore, when the charges detonate, there will be no debris resultant from the detonation.

4 Claims, 6 Drawing Sheets

FIG. 4a
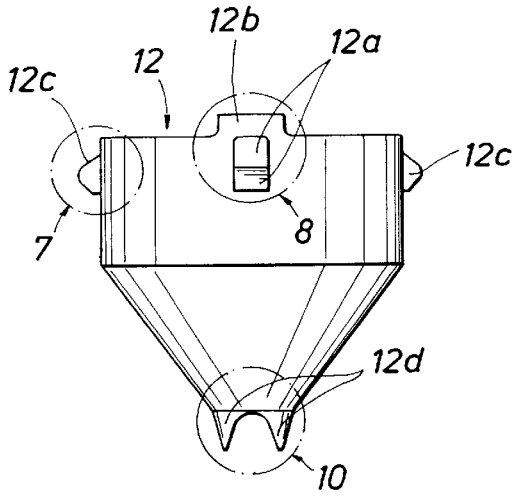
FIG. 4c
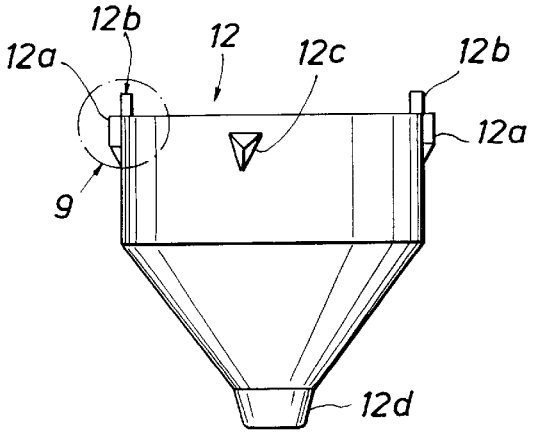
FIG. 4b
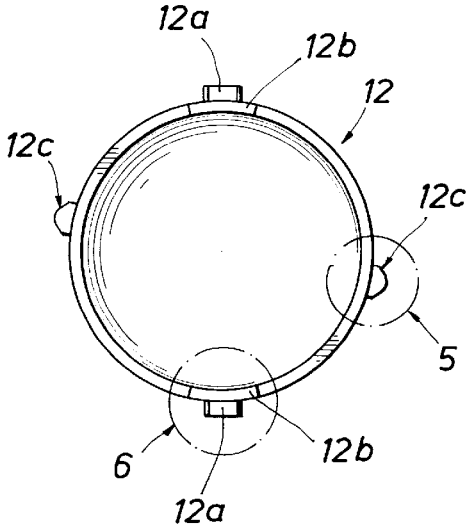
FIG. 4d
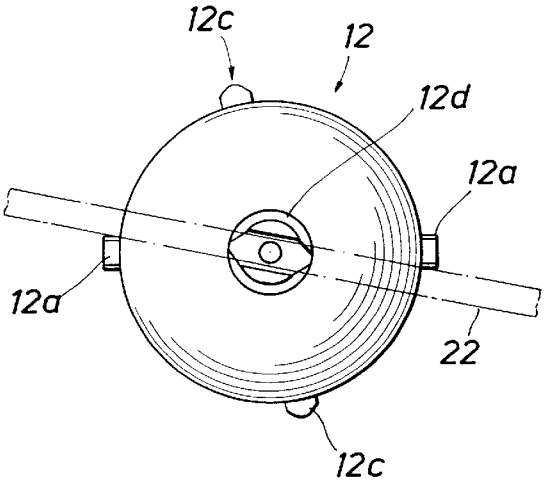
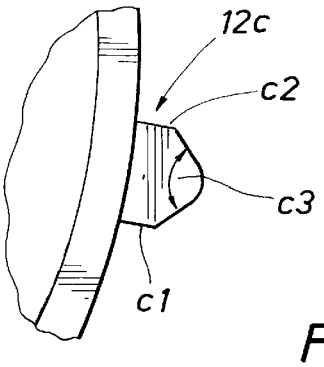
FIG. 5

INSERT AND TWIST METHOD AND APPARATUS FOR SECURING A SHAPED CHARGE TO A LOADING TUBE OF A PERFORATING GUN

CROSS-REFERENCE TO RELATED APPLICATIONS

This application is a division of application Ser. No. 08/004,024, filed on Jan. 15, 1993, now U.S. Pat. No. 5,862,758.

BACKGROUND OF THE INVENTION

The subject matter of the present invention relates to perforating guns for use in connection with oil wellbores, and more particularly, to an insert and twist method and apparatus adapted for securing a shaped charge case, including the charge liner, to a loading tube of the perforating gun.

In a perforating gun adapted to be disposed in a wellbore, a shaped charge is inserted into a mating hole of a loading tube, and a charge retention apparatus holds the charge firmly within the mating hole. The charge retention apparatus normally include retaining rings, charge retention jackets, clips, or bending tabs, all of which are designed to secure the shaped charge to the loading tube. When the shaped charge detonates, the charge retention apparatus will shatter into a multitude of pieces producing debris which will fall to a bottom of the wellbore. However, this debris can ultimately interfere with other operations taking place within the wellbore. Consequently, it is desirable to provide a method and apparatus for securing the shaped charge to the loading tube of a perforating gun without using a separate charge retention apparatus, such as retaining rings or clips or bending tabs, to secure the shaped charge to the loading tube.

SUMMARY OF THE INVENTION

Accordingly, it is a primary object of the present invention to provide a method and apparatus for securing a shaped charge to a loading tube of a perforating gun without using a separate charge retention apparatus, such as a retaining ring or a charge retention jacket or a clip or a bending tab, to secure the shaped charge to the loading tube.

It is a further object of the present invention to provide an insert and twist method and apparatus for securing a shaped charge to a loading tube of a perforating gun wherein the shaped charge is inserted into a mating hole in the loading tube and is twisted clockwise a predetermined circumferential distance, the shaped charge being firmly secured to the loading tube when the charge is twisted the predetermined distance.

It is a further object of the present invention to provide an insert and twist method and apparatus for securing a shaped charge to a loading tube of a perforating gun wherein the shaped charge has a case which includes a first apparatus disposed around the case, the loading tube has a mating hole which includes a specific contour, the first apparatus of the shaped charge case and the specific contour of the loading tube mating hole cooperating to firmly hold the shaped charge into the loading tube when the shaped charge is inserted into the mating hole of the loading tube and is twisted a predetermined clockwise circumferential distance.

It is a further object of the present invention to provide an insert and twist method and apparatus for securing a shaped charge to a loading tube wherein a shaped charge case of the shaped charge includes a pair of retaining lugs and a pair of shoulder lugs, and the loading tube includes a mating hole, the mating hole having a specific contour, which contour includes first and second slots, each slot adapted to receive one of the retaining lugs, and a first and second pair of grooves, each groove of each pair being adapted to receive one of the shoulder lugs, the shaped charge case being firmly secured to the loading tube when the shaped charge case is inserted into the mating hole of the loading tube, the pair of retaining lugs are received in the first and second slots, the pair of shoulder lugs are received in a corresponding one of the grooves of the first and second pair of grooves, and the shaped charge case is twisted clockwise a predetermined circumferential distance.

These and other objects of the present invention are accomplished by designing a loading tube of a perforating gun to include a plurality of mating holes, where each mating hole has a specific and predetermined contour, and designing a case of a shaped charge to include a pair of retaining lugs and a pair of shoulder lugs, which lugs are adapted to uniquely cooperate with the contour of the mating hole of the loading tube for securing the go shaped charge to the loading tube. The predetermined contour of each mating hole includes a pair of slots disposed opposite one another in the mating hole, and a pair of grooves disposed opposite one another in the mating hole but offset from the pair of slots. Each pair of grooves includes a large radius groove and a small radius groove. The pair of retaining lugs of the shaped charge case are adapted to be received, respectively, in the pair of slots of the contour of the mating hole of the loading tube; whereas the pair of shoulder lugs are adapted to be initially received in the pair of large radius grooves of the contour of the mating hole. When the shaped charge is twisted clockwise in a circumferential direction, the retaining lugs move out of their respective slots and under a surface of the loading tube; in addition, the shoulder lugs move out of their respective large radius grooves and into their respective small radius grooves. The shoulder lugs, when disposed in the small radius grooves, prevent any further circumferential movement and any further inward radial movement of the shaped charge; whereas the retaining lugs, when disposed under the surface of the loading tube, prevent any further outward radial movement of the shaped charge. At this point, the shaped charge case is firmly held into the mating hole of the loading tube. No clips, bending tabs, retaining rings, or charge retention jackets are being used to hold the shaped charge to the loading tube; therefore, when the charges detonate, there will be no debris resultant from shattered clips, tabs, rings, or jackets.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are. given by way of illustration only and are not intended to be limitative of the present invention, and wherein:

FIG. 4*a* illustrates a front view of the shaped charge case of FIG. 3;

FIG. 4*b* illustrates a top view of the shaped charge case of FIG. 4*a;*

FIG. 4*c* illustrates a side view of the shaped charge case of FIG. 4*a;*

FIG. 4*d* illustrates a bottom view of the shaped charge case of FIG. 4*c;*

FIGS. 5 and 7 illustrate detailed views of the construction of the shoulder lug, a portion of the shaped charge case of FIGS. 4*a*–4*d;*

DETAILED DESCRIPTION OF THE PREFERRED EMBODIMENT

Figure 1:
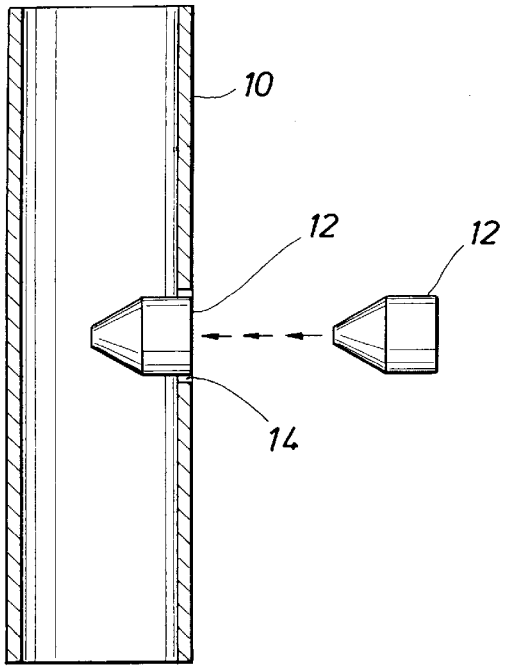
FIG. 1 illustrates a simplified verion of a loading tube adapted for retaining a shaped charge.
Figure 2:
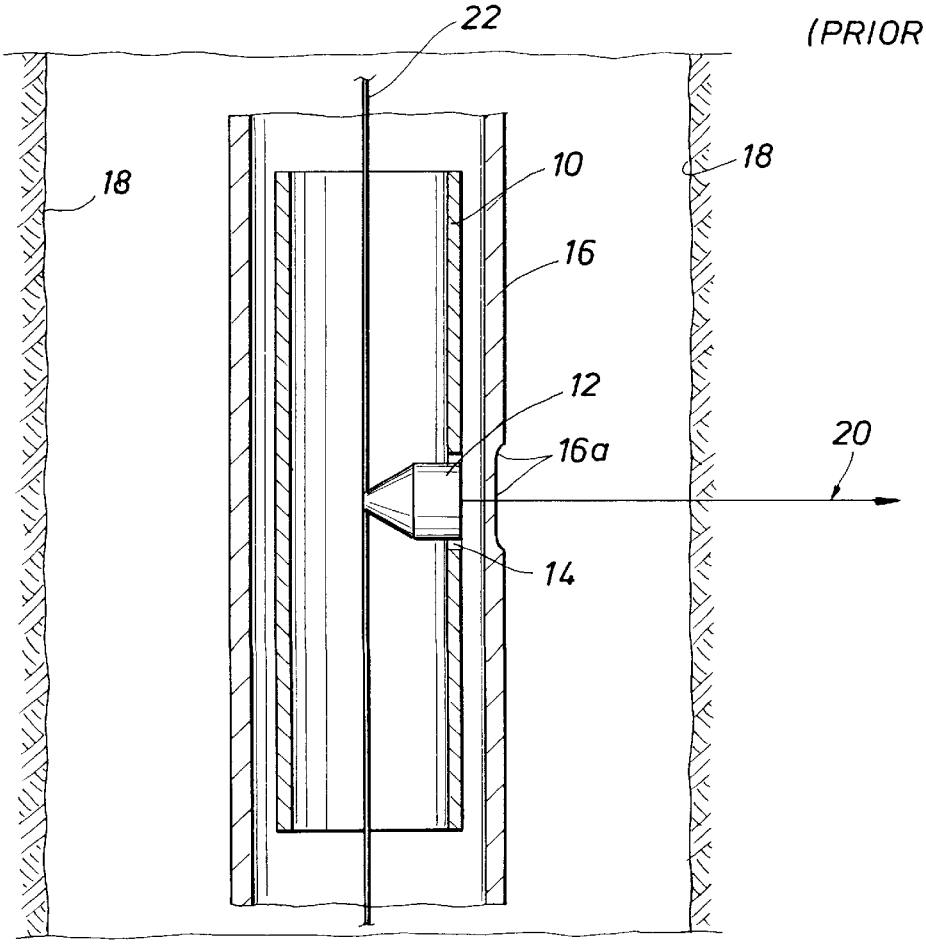
FIG. 2 (PRIOR ART)
FIG. 2 illustrates the loading tube of FIG. 1 retaining and holding the shaped charge disposed within a perforating gun carrier.

Referring to FIGS. 1 and 2, a loading tube adapted for holding a shaped charge is illustrated.

Figure 3:
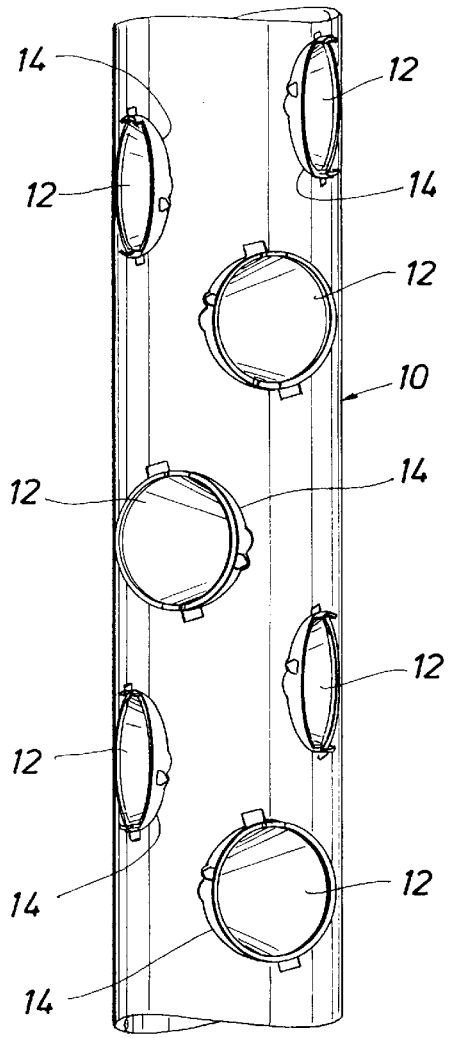
FIG. 3 illustrates a loading tube, in accordance with the present invention, retaining and holding a plurality of shaped charges, each charge having a case designed, in accordance with the present invention, to be held firmly within a mating hole in the loading tube.

In FIG. 1, a loading tube 10 includes a mating hole 14, and a shaped charge case 12, which includes a shaped charge, is firmly held within the mating hole 14 of the loading tube 10. The loading tube of FIG. 1 has only one mating hole; in reality, as shown in FIG. 3, a plurality of mating holes are adapted for receiving a plurality of shaped charge cases 12.

In FIG. 2, the loading tube 10 and associated shaped charge case 12 is inserted into a carrier 16 of a perforating gun. A detonating cord 22 is connected to each shaped charge case 12. The perforating gun including the carrier 16 is lowered into a wellbore 18. The carrier 16 includes a recess 16*a* which coincides with an axis of the shaped charge case 12 disposed within the mating hole 14 of the loading tube 10. When a detonation wave propagates within detonating cord 22, the detonation wave detonates the shaped charge disposed within the charge case 12; when the shaped charge detonates, a jet 20 is formed. The jet 20 propagates from the shaped charge, perforates the recess 16*a* of the carrier 16, and perforates a formation traversed by the wellbore 18.

The shaped charge case 12 is usually held within the mating hole 14 of loading tube 10 by either clips, bending tabs, charge retention jackets, or retaining rings. When the shaped charge in case 12 detonates, the clips tabs, rings, or jackets shatter into a multitude of pieces producing debris, and the debris falls to a bottom of the wellbore. This debris could interfere with other operations taking place within the wellbore.

Therefore, another new method and apparatus is needed for firmly holding the charge case 12 within the mating hole 14 of the loading tube 10. The new apparatus should not include clips, tabs, rings, or jackets, and the shaped charge case 12 should rot shatter forming debris when the associated shaped charge detonates.

Referring to FIG. 3, a loading tube 10, in accordance with one part of the present invention, and a plurality of shaped charge cases 12 containing shaped charges, in accordance with another part of the present invention, is illustrated.

The loading tube 10, in accordance with the present invention, includes a plurality of mating holes, each mating hole having a contour. A shaped charge case 12 which includes a shaped charge is inserted into each mating hole, each shaped charge case including a plurality of lugs. The lugs of the shaped charge case 12 in association with the contour of each mating hole 14 in the loading tube 10 retain and firmly hold the shaped charge case 12 in its mating hole 14 when the shaped charge case 12 is inserted into the mating hole 14 and is twisted in a clockwise, circumferential direction.

In FIG. 3, the loading tube 10 includes a plurality of mating holes 14. The case 12 of a shaped charge is first inserted into each mating hole 14; when each shaped charge case 12 is inserted into its mating hole 14, each shaped charge case 12 is twisted in a clockwise, circumferential direction. When each shaped charge case 12 is twisted, the shaped charge cases are all firmly held within their respective mating holes 14. As noted in FIG. 2, when the shaped charge cases 12 are firmly held within their respective mating holes 14, the loading tube 10 is inserted within a carrier 16 of a perforating gun; the carrier 16 and associated loading tube 10 is lowered into a wellbore 18. When the shaped charges detonate in response to the detonation wave propagating within the detonating cord 22, a jet 20 is formed which perforates the wellbore 18.

A detailed description of the loading tube 10 including its mating hole 14 contour, which is one part of the present invention, and the shaped charge case 12, which is another part of the present invention, will be set forth in the following paragraphs with reference to FIGS. 4*a*–13*b*.

Referring to FIGS. 4*a*–4*c*, top, front, side, and bottom views of the shaped charge case 12 of FIGS. 1–3 is illustrated.

In FIG. 4*a*, a front view of the shaped charge case 12 is illustrated. The shaped charge case 12 includes a retaining lug 12*a* and a support lug 12*b* disposed on one side of the case and another retaining lug 12*a* and support lug 12*b* disposed on the other side of the case 12. The case 12 also includes a shoulder lug 12*c* disposed on one side of case 12 between the two retaining/support lugs 12*a*/12*b* and another shoulder lug 12*c* disposed on the other side of case 12 between the two retaining/support lugs 12*a*/12*b*. The case 12 further includes a bottom end 12*d* adapted for connection to the detonating cord 22.

In FIG. 4*b*, a top view of the shaped charge case 12 illustrated. In this view, the case 12 is shown as including the retaining lug 12*a* and support lug 12*b* disposed on two sides of the case 12 and the two shoulder lugs 12*c* disposed on two other sides of the case 12, each shoulder lug 12 being disposed between the two adjacent retaining and support lugs 12*a*, 12*b*.

In FIG. 4*c*, a side view of the shaped charge case 12 is illustrated. In this view, the case 12 includes the shoulder lug 12*c* disposed between a pair of retaining lugs 12*a* and a pair of support lugs 12*b*. A bottom end 12*d* is also shown adapted for connecting to a detonating cord 22. In FIG. 4*d*, a bottom view of the shaped charge case 12 is illustrated. In this view, the bottom end 12*d* is adapted for receiving a detonating cord 22 for detonating the shaped charge disposed within the charge case 12. A pair of shoulder lugs 12*c* are illustrated as being disposed opposite one another, but somewhat angularly oriented with respect to a pair of the retaining lugs 12*a*.

Referring to FIGS. 5–10, various detail sections of the shaped charge case 12 shown in FIGS. 4*a*–4*d* are illustrated.

Figure 7:
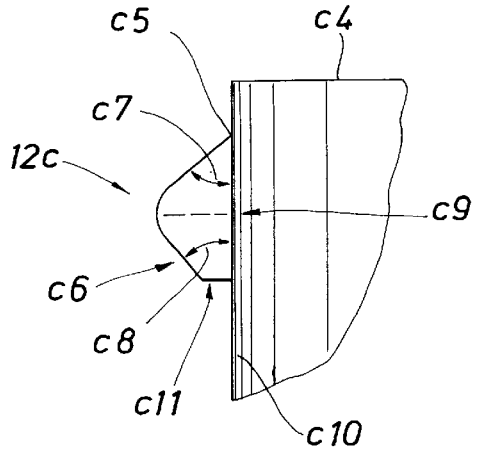

Referring to FIGS. 5 and 7, a detail section of the shoulder lug 12*c*, identified as details A and C in FIGS. 4*b* and 4*a*, respectively, is illustrated.

In FIG. 5, the shoulder lug 12*c* is 0.200 inches in length extending from side c1 to side c2, and has an angle c3 of 90 degrees. The lug 12*c* is 0.989 inches to the center of the shaped charge case 12.

In FIG. 7, the distance from the top c4 of the shaped charge case 12 to the top c5 of the lug 12*c* is 0.106 inches, and the distance from the top c4 of the shaped charge case 12 to the bottom c6 of the lug 12*c* is 0.350 inches. The angle c7 is 51 degrees and the angle c8 is 39 degrees. The distance from the top c4 of the shaped charge case to a point c9 is 0.235 inches. The distance from a side c10 to a point c11 is 0.047 inches.

Figure 6:
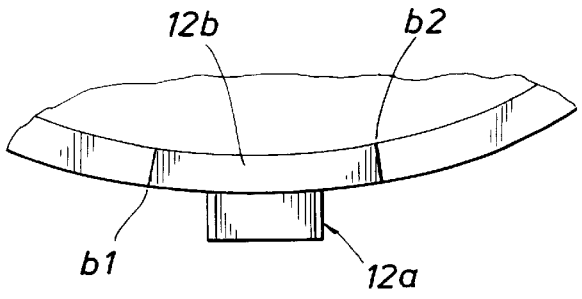
FIGS. 6, 8, and 9 illustrate detailed views of the construction of the retaining lug and the support lug, a portion of the shaped charge case of FIGS. 4*a*–4*d*.
Figure 8:
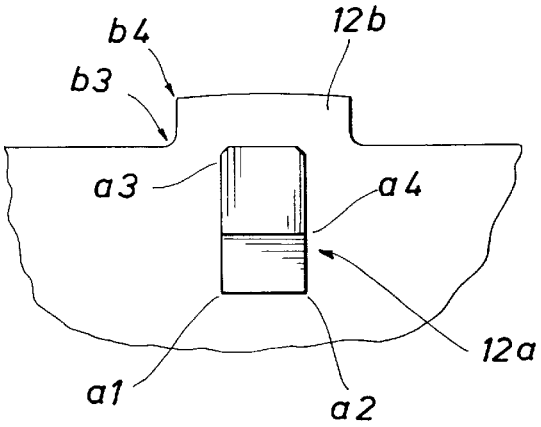
Figure 9:
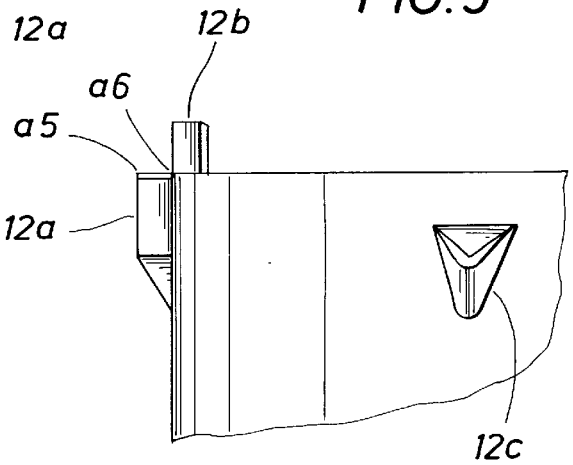

Referring to FIGS. 6, 8, and 9, a detail section of the retaining lug 12*a* and support lug 12*b*, identified as details B. D and E in FIGS. 4*b*, 4*a*, and 4*c*, respectively, is illustrated.

In FIG. 6, a top view of the retaining lug 12*a* and support lug 12*b* is illustrated. The length of the support lug 12*b* from point b1 to point b2 is 0.400 inches.

In FIG. 8, a front view of the retaining lug 12*a* and support lug 12*b* is illustrated. The length of the retaining lug 12*a*, from point al to point a2, is 0.200 inches, and the width or height of the retaining lug 12*a*, from point al to point a3, is 0.350 inches. The height or width of the retaining lug 12*a* from point a4 to point a3 is 0.200 inches. The height of the support lug 12*b* from point b3 to point b4 is 0.125 inches.

In FIG. 9, a side view of the retaining lug 12*a* and support lug 12*b* including shoulder lug 12*c* is illustrated. The depth of the retaining lug 12*a* from point a5 to point a6 is 0.080 inches.

Figure 10:
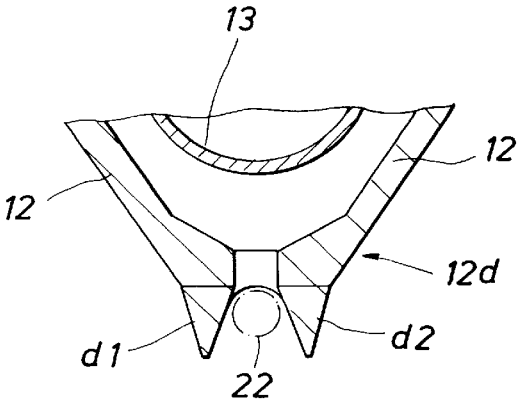
FIGS. 10 illustrates a detailed view of the construction of a bottom end of the shaped charge case of FIGS. 4*a*–4*d*.

Referring to FIG. 10, a detail section of the bottom end 12*d* of the shaped charge case 12, identified as detail F in FIGS. 4*a*, is illustrated.

In FIG. 10, the detonating cord 22 is disposed within a groove defined by a part d1 and another part d2. A shaped charge 13 is disposed within an internal space of the shaped charge case 12. The distance (diameter) between part d1 and part d2 is 0.375 inches. The internal angle between part d1 and part d2 is 39 degrees.

Figure 11A:
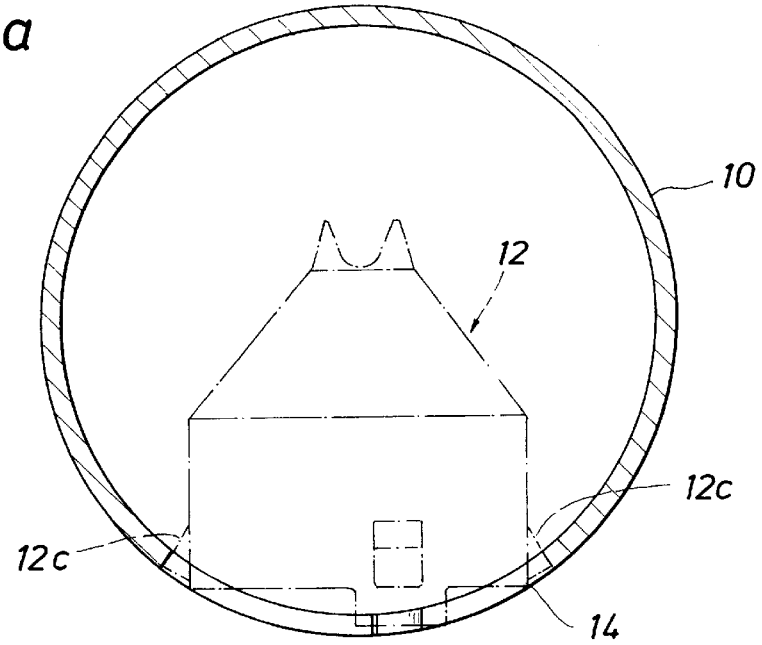
FIG. 11*a* illustrates a top view of the loading tube of FIG. 2.
Figure 11B:
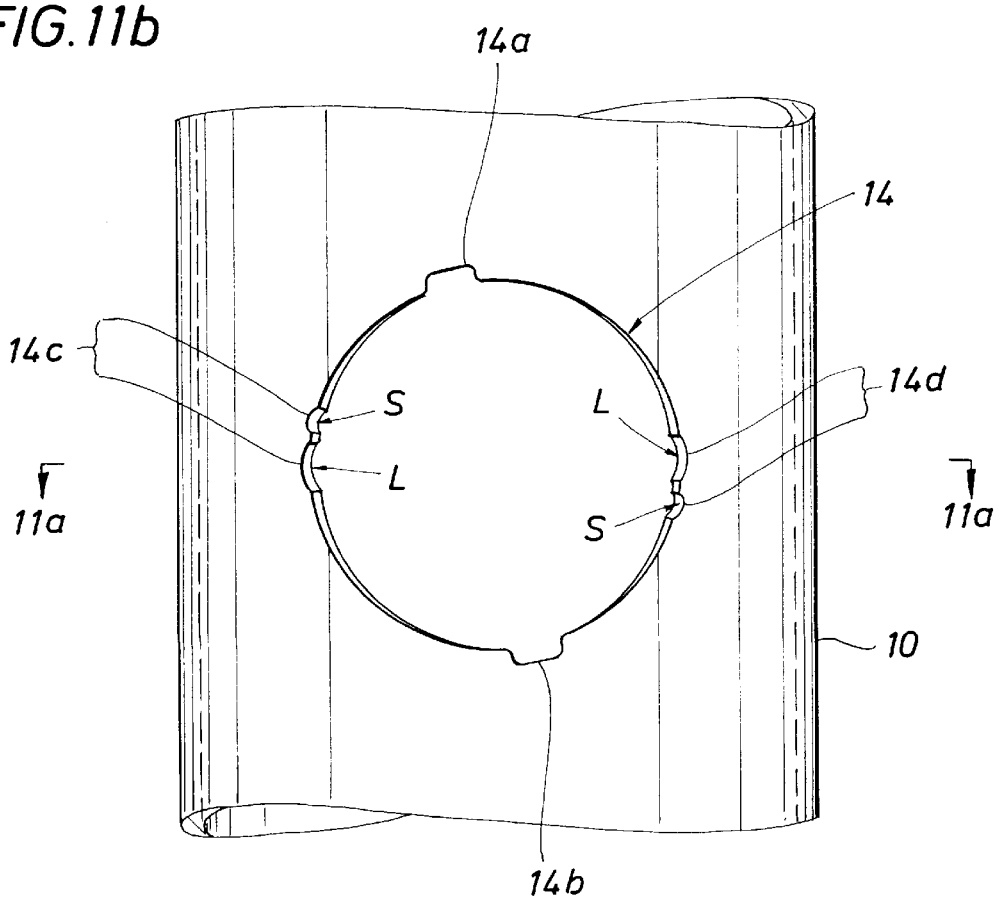
FIG. 11*b* illustrates a cross sectional view of the loading tube of FIG. 11*a* taken along section lines 11*b*–11*b* of FIG. 11*a;*

Referring to figures 11*a*–11*b*, a top view of the loading tube 10 and a cross sectional view of the loading tube 10 showing the mating hole 14 in the loading tube 10 is illustrated.

In FIG. 11*a*, a top view of the loading tube 10 is illustrated. A mating hole 14 is disposed through one side of the tube 10.

In FIG. 11*b*, a cross sectional front view of the loading tube 10 of FIG. 11*a*, taken along section lines 11*b*—11*b* of FIG. 11*a* is illustrated. In FIG. 11*b*, the mating hole 14 has a contour, and the contour of the mating hole 14 includes a first slot 14*a*, a second slot 14*b* disposed opposite the first slot, a first pair of grooves 14*c* and a second pair of grooves 14*d* disposed opposite the first pair of grooves. Each pair of grooves 14*c* and 14*d* include a small diameter groove S and a large diameter groove L. The slots 14*a* and 14*b* are adapted to initially receive the retaining lugs 12*a* of the shaped charge case 12, and the large diameter grooves L of the pair of grooves 14*c* and 14*d* are adapted to initially receive the shoulder lugs 12*c* of the shaped charge case 12 (that is, at a point in time prior to twisting the shaped charge case 12 in the clockwise circumferential direction). The small diameter grooves S of the pair of grooves 14*c* and 14*d* are adapted to subsequently receive the shoulder lugs 12*c* of the shaped charge case 12 (that is, at a point in time after twisting the shaped charge case in the clockwise direction).

Figure 12:
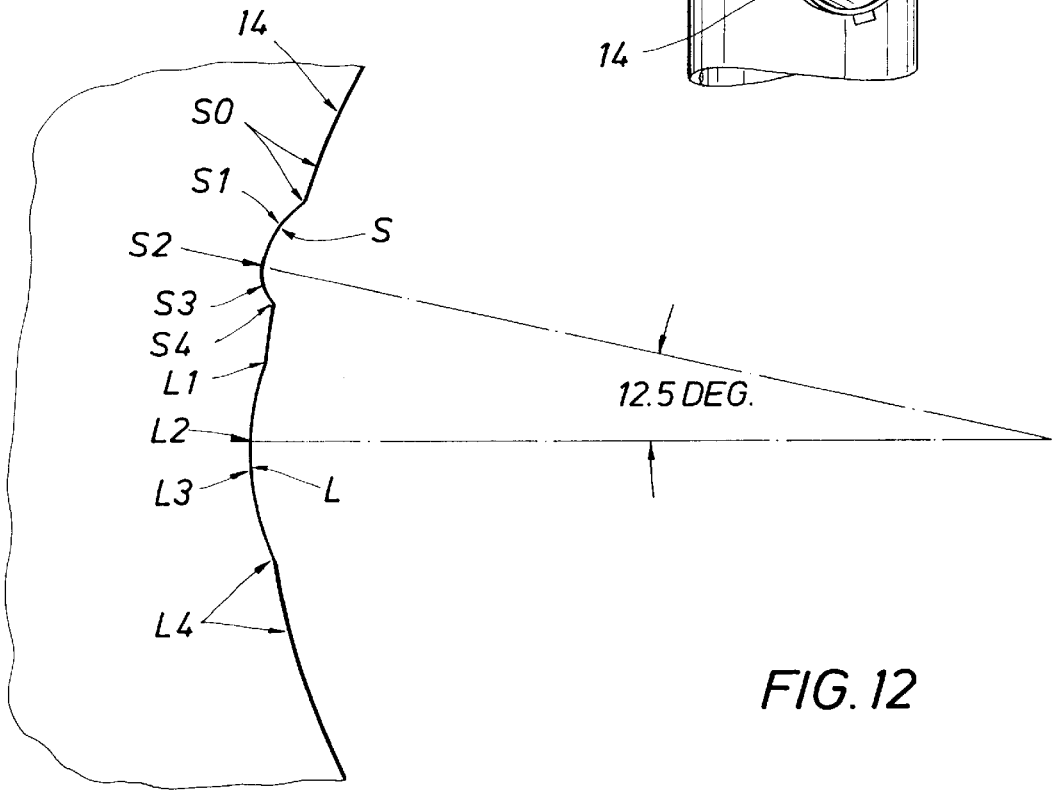
FIG. 12 illustrates an amplified view of a portion of the contour of a mating hole in the loading tube of FIG. 11*b;*

Referring to FIG. 12, an amplified or expanded view of the contour of each of the plurality of mating holes 14 of FIGS. 3 and 11*b* is illustrated. In FIG. 12, as noted above with reference to FIG. 11*b*, the contour of each mating hole 14 includes the pair of grooves 14*c* and 14*d* disposed opposite one another. Each pair of grooves 14*c*, 14*d* include the small diameter groove S and the large diameter groove L. The mating hole 14, not including the slots 14*a* and 14*b* or grooves 14*c* and 14*d*, has a diameter of 1.900 inch. The small diameter groove S includes the following points: point S0 is the beginning of the small diameter groove and having a 1.900 inch diameter or 0.950 inch radius to the center of the mating hole 14; point S1 has a 0.120 inch radius to the center of the small diameter arc (not to the center of the mating hole); point S2 has a 0.978 inch radius to center of the mating hole; point S3 has a 0.060 inch radius to the center of the small diameter arc; and point S4 has a 0.960 inch radius to center of the mating hole. The large diameter groove L includes the following points: point L1 has a 0.965 inch radius to center of the mating hole; point L2 has a 0.980 inch radius to center of mating hole; point L3 has a 0.293 inch radius to center of the large diameter arc (not to the center of the mating hole); and point L4 is the end of the large diameter groove and has a 1.900 inch diameter or 0.950 inch radius to center of the mating hole. The large diameter groove L and the small diameter groove S are separated by an angle of 12.5 degrees.

A functional description of the operation of the present invention is set forth in the following paragraphs with reference to FIGS. 13*a* and 13*b* of the drawings.

Figure 13A:
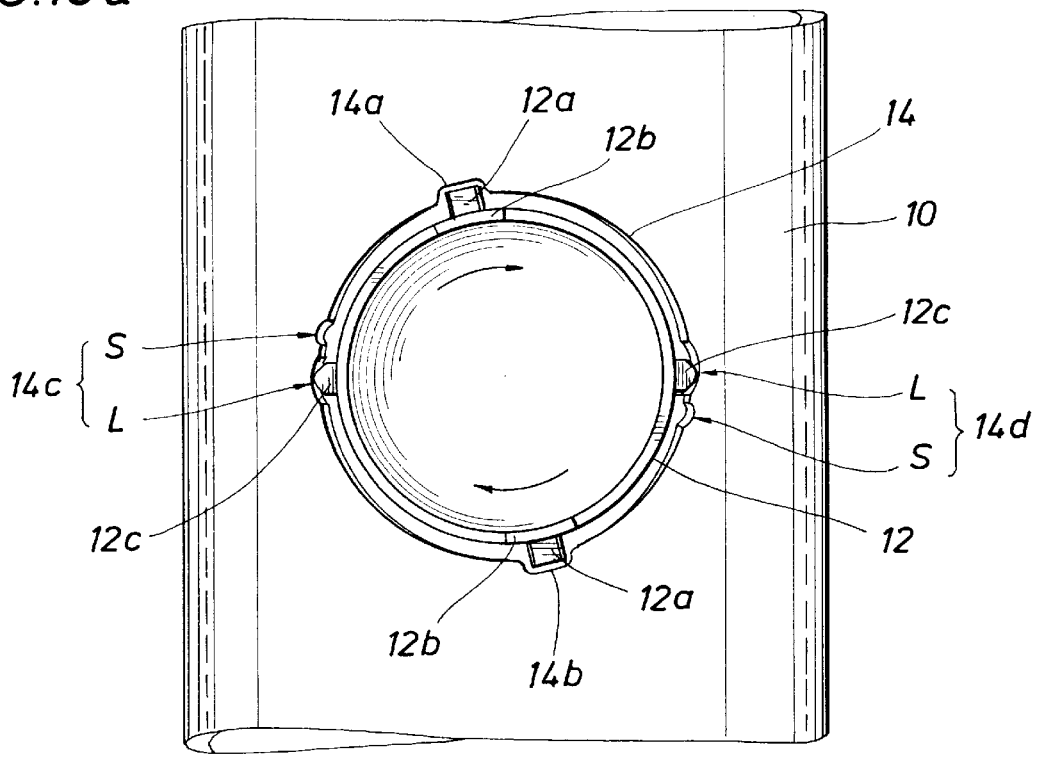
FIG. 13*a* illustrates the shaped charge case of FIGS. 4*a*–4*d* in accordance with the present invention after being inserted into a mating hole of a loading tube, where the mating hole has a predetermined contour also in accordance with the present invention, but prior to twisting the shaped charge case clockwise for holding the shaped charge case firmly in the mating hole of the loading tube.

In FIG. 13*a*, a shaped charge case 12 is inserted into a mating hole 14 of a loading tube 10 prior to inserting the loading tube in a perforating gun carrier 16. The pair of retaining lugs 12;a are inserted into slots 14*a* and 14*b* of the mating hole 14 and, simultaneously, the pair of shoulder lugs 12*c* are inserted into the first and second pair of grooves 14*c* and 14*d*, the lugs 12*c* being initially inserted into the large diameter groove L associated with the first and second pair of grooves 14*c*, 14*d*. At this point, a wrench is required. The wrench is secured to the pair of support lugs 12*b* and twisted clockwise, as indicated in FIG. 13*a*. The clockwise torque provided by the wrench on the support lugs 12*b* moves the shaped charge case 12 in a clockwise circumferential direction.

Figure 13B:
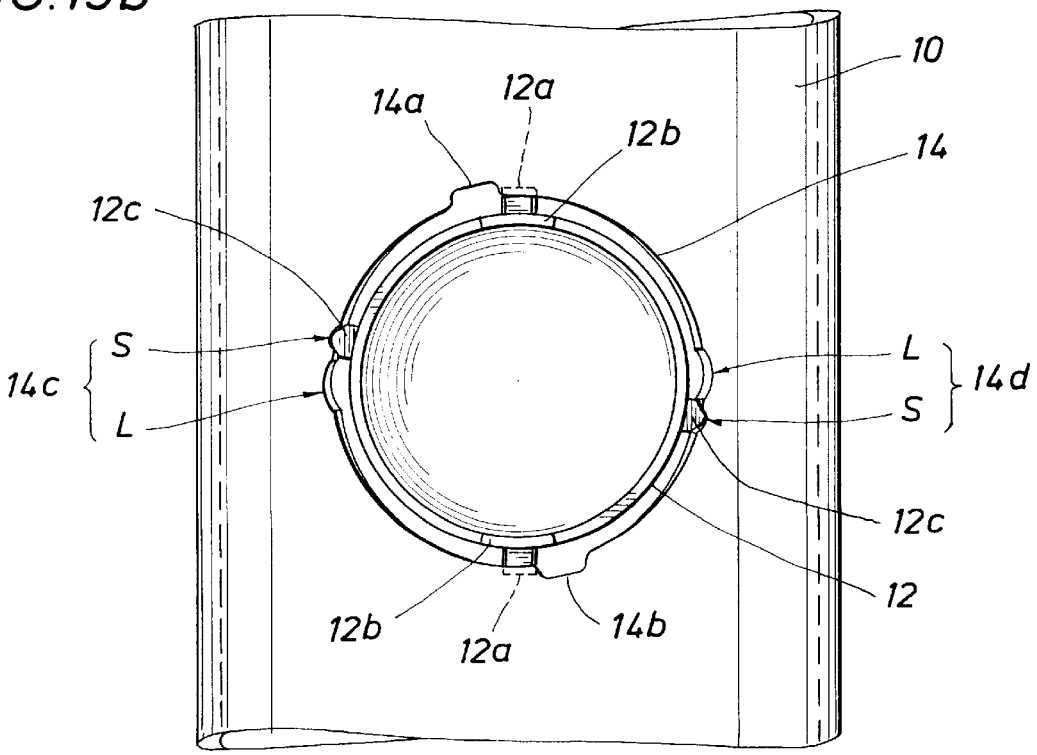
FIG. 13*b* illustrates the shaped charge case of FIG. 13*a* after being inserted into the mating hole of the loading tube and after twisting the shaped charge case clockwise, the shaped charge case being firmly held within the mating hole of the loading tube after being twisted in the clockwise direction.

In FIG. 13*b*, during the movement of the shaped charge case 12 in the clockwise circumferential direction, an end portion of the retaining lugs 12*a* move underneath a surface of the loading tube 10. Simultaneously, the pair of shoulder lugs 12*c* move out of the large diameter groove L of the pair of grooves 14*c* and 14*d* and into the small diameter groove S of the pair of grooves 14*c* and 14*d*. In this position, the surface of the loading tube 10 prevents the retaining lugs 12*a* of the shaped charge case 12 from moving in an outward radial direction; and the small diameter groove S prevents the shoulder lugs 12*c* from moving in an inward radial direction. In addition, the small diameter groove S of the first and second pair of grooves 14*c* and 14*d* prevents the shaped charge case 12 from moving either clockwise or counter-clockwise in a circumferential direction. As a result, the shaped charge case 12 is secure in its position within the mating hole 14 of the loading tube. The case 12 cannot move in any direction; and the case 12 is secured to the mating hole 14 of loading tube 10 without the use of any bending tabs, clips, retention jackets, or retaining rings. When the shaped charge disposed within the case 12 detonates, there will be no debris resultant from the detonation; and, therefore, there will be no interference with any other operations taking place within the wellbore.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. Perforating apparatus, comprising:

a loading tube including at least one hole disposed through a wall of said loading tube, said hole having a periphery, the periphery including a first groove and a second groove; and a shaped charge including a case adapted to be received in the hole in the wall of said loading tube and twisted in a circumferential direction a predetermined distance, said case having a first lug and a second lug, said first lug being inserted into said first groove and said second lug being inserted into said second groove of said periphery of said hole when said shaped charge is received in the hole in the wall of said loading tube.

2. The perforating apparatus of claim 1, wherein said periphery of said hole includes a third groove, a portion of said first lug moving out of said first groove and disappearing beneath the periphery of said hole and said second lug moving out of said second groove and into said third groove when said shaped charge is twisted in the circumferential direction the predetermined distance.

3. A charge retention apparatus, comprising:

a tube including at least one hole disposed through a wall of said tube, said hole having a periphery, the periphery including a first groove and a second groove; and a charge including a case adapted to be received in the hole in the wall of said tube and twisted in a circumferential direction, a predetermined distance, said case having a first lug and a second lug, said first lug being inserted into said first groove and said second lug being inserted into said second groove of said periphery of said hole when said charge is received in the hole in the wall of said tube.

4. The charge retention apparatus of claim 3, wherein said periphery of said hole includes a third groove, a portion of said first lug moving out of said first groove and disappearing beneath the periphery of said hole and said second lug moving out of said second groove and into said third groove when said charge is twisted in the circumferential direction the predetermined distance.

* * * * *